US011170740B2

(12) United States Patent
Soni et al.

(10) Patent No.: US 11,170,740 B2
(45) Date of Patent: Nov. 9, 2021

(54) DETERMINING ALLOWABLE LOCATIONS OF TEAR LINES WHEN SCANNING OUT RENDERED DATA FOR DISPLAY

(71) Applicant: NVIDIA Corporation, Santa Clara, CA (US)

(72) Inventors: Radhika Ranjan Soni, Pune (IN); Gaurav Singh, Pune (IN)

(73) Assignee: NVIDIA Corporation, Santa Clara, CA (US)

( * ) Notice: Subject to any disclaimer, the term of this patent is extended or adjusted under 35 U.S.C. 154(b) by 0 days.

(21) Appl. No.: 16/029,495

(22) Filed: Jul. 6, 2018

(65) Prior Publication Data

US 2019/0164524 A1 May 30, 2019

Related U.S. Application Data

(60) Provisional application No. 62/591,657, filed on Nov. 28, 2017.

(51) Int. Cl.
*G09G 5/37* (2006.01)

(52) U.S. Cl.
CPC ..... *G09G 5/37* (2013.01); *G09G 2320/106* (2013.01); *G09G 2340/0435* (2013.01); *G09G 2354/00* (2013.01)

(58) Field of Classification Search
None
See application file for complete search history.

(56) References Cited

U.S. PATENT DOCUMENTS

| | | | | |
|---|---|---|---|---|
| 8,970,495 | B1 * | 3/2015 | Biffle | G09G 5/08 345/158 |
| 2012/0115601 | A1 * | 5/2012 | Dietrich, Jr. | H04L 65/605 463/31 |
| 2016/0117288 | A1 * | 4/2016 | Sills | G06F 3/1446 715/252 |
| 2016/0357493 | A1 * | 12/2016 | Zerwas | G06F 3/1438 |
| 2018/0024630 | A1 * | 1/2018 | Goossens | G06F 3/011 345/156 |
| 2018/0270399 | A1 * | 9/2018 | Sorbo | G09G 5/399 |

* cited by examiner

*Primary Examiner* — Hilina K Demeter
(74) *Attorney, Agent, or Firm* — Artegis Law Group, LLP

(57) ABSTRACT

A technique for selecting locations of tear lines when displaying visual content. The technique includes receiving coordinates for one or more portions of a display where a tear is permitted and determining if a frame transition is to occur while rendered content is being scanned out for display within the one or more portions of the display where tear is permitted. If the frame transition is to occur while the scanline for the display is in the one or more portions of the display where tear is permitted, then the technique further includes allowing the frame transition to occur. If the frame transition is to occur while the scanline for the display is not in the one or more portions of the display where tear is permitted, then the technique further includes delaying the frame transition until at least when the scanline for the display is in the one or more portions of the display where tear is permitted.

20 Claims, 8 Drawing Sheets

DETERMINING ALLOWABLE LOCATIONS OF TEAR LINES WHEN SCANNING OUT RENDERED DATA FOR DISPLAY

CROSS-REFERENCE TO RELATED APPLICATIONS

This application claims priority benefit of the United States Provisional Patent Application titled, "SMART TEAR MODE," filed on Nov. 28, 2017 and having Ser. No. 62/591,657. The subject matter of this related application is hereby incorporated herein by reference.

BACKGROUND

Field of the Various Embodiments

Various embodiments relate generally to displaying video and, more specifically, to determining allowable locations of tear lines when scanning out rendered data for display.

Description of the Related Art

"Screen tearing" in the form of "tear lines" is an undesirable visual artifact that oftentimes occurs when generating frames of content for display on a display device. A tear line typically appears in a display as a horizontal discontinuity when, for example, a translational shift exists between a portion of a display below the tear line and a portion of the display above the tear line. The tear line creates a torn look to the content being displayed because the edges of objects that are displayed across the tear line fail to align.

Tear lines usually result when there is motion within the content being rendered for display, and the content is being rendered at a rate that is greater than the refresh rate of the display device. In such situations, a difference in phase exists between the processing of the display content and the refresh rate of the display device. A tear line generally moves across the display as the difference in phase changes. The speed of that movement is proportional to the difference in phase. Screen tearing can occur with most common display technologies and graphics cards and is most noticeable in horizontally-moving displays, such as in slow camera pans in a movie or classic side-scrolling video games.

In an effort to reduce screen tearing, a vertical synchronization, or "Vsync," function on the graphics card is oftentimes employed. When the Vsync function is implemented, the rate at which the graphics card output frames for display is synchronized to or matched with the refresh rate of the display device, which reduces instances of screen tearing. One drawback to this approach, however, is that implementing the Vsync function usually reduces or throttles the output of the graphics card, which reduces overall performance and can introduce other undesirable visual artifacts, such as judder (i.e., a slight jerking motion of the video) and video lag. The reduced performance and secondary visual artifacts can degrade the overall gaming experience, especially with games that require precise timing or fast reaction times.

As the foregoing illustrates, what is needed in the art are more effective techniques for reducing screen tearing when generating and displaying content.

SUMMARY

Various embodiments set forth techniques or systems that involve receiving coordinates for one or more portions of a display where a tear is permitted, and determining if a frame transition is to occur while rendered content is being scanned out for display within the one or more portions of the display. If the frame transition is to occur while the scanline for the display is in the one or more portions of the display where tear is permitted, then the techniques or systems may involve allowing the frame transition to occur. If, however, the frame transition is to occur while the scanline for the display is not in the one or more portions of the display where tear is permitted, then the techniques or systems may involve delaying the frame transition until at least when the scanline for the display is in the one or more portions of the display where tear is permitted.

The disclosed techniques provide a technological improvement relative to the prior art in that dynamically detected video objects having relatively high importance may remain intact while screen tearing occurs in other portions of a display. With the disclosed techniques, screen tearing in relatively important parts of a frame is reduced or avoided without throttling the output of the graphics card and without introducing other undesirable visual artifacts.

BRIEF DESCRIPTION OF THE DRAWINGS

So that the manner in which the above recited features of the various embodiments can be understood in detail, a more particular description of the embodiments, briefly summarized above, may be had by reference to the embodiments, some of which are illustrated in the appended drawings. It is to be noted, however, that the appended drawings illustrate only typical embodiments and are therefore not to be considered limiting of its scope, for various embodiments may admit to other equally effective embodiments.

For clarity, identical reference numbers have been used, where applicable, to designate identical elements that are common between figures. It is contemplated that features of one embodiment may be incorporated in other embodiments without further recitation.

DETAILED DESCRIPTION

In the following description, numerous specific details are set forth to provide a more thorough understanding of the various embodiments. However, it will be apparent to one of skill in the art that the various embodiments may be practiced without one or more of these specific details.

System Overview

Figure 1:
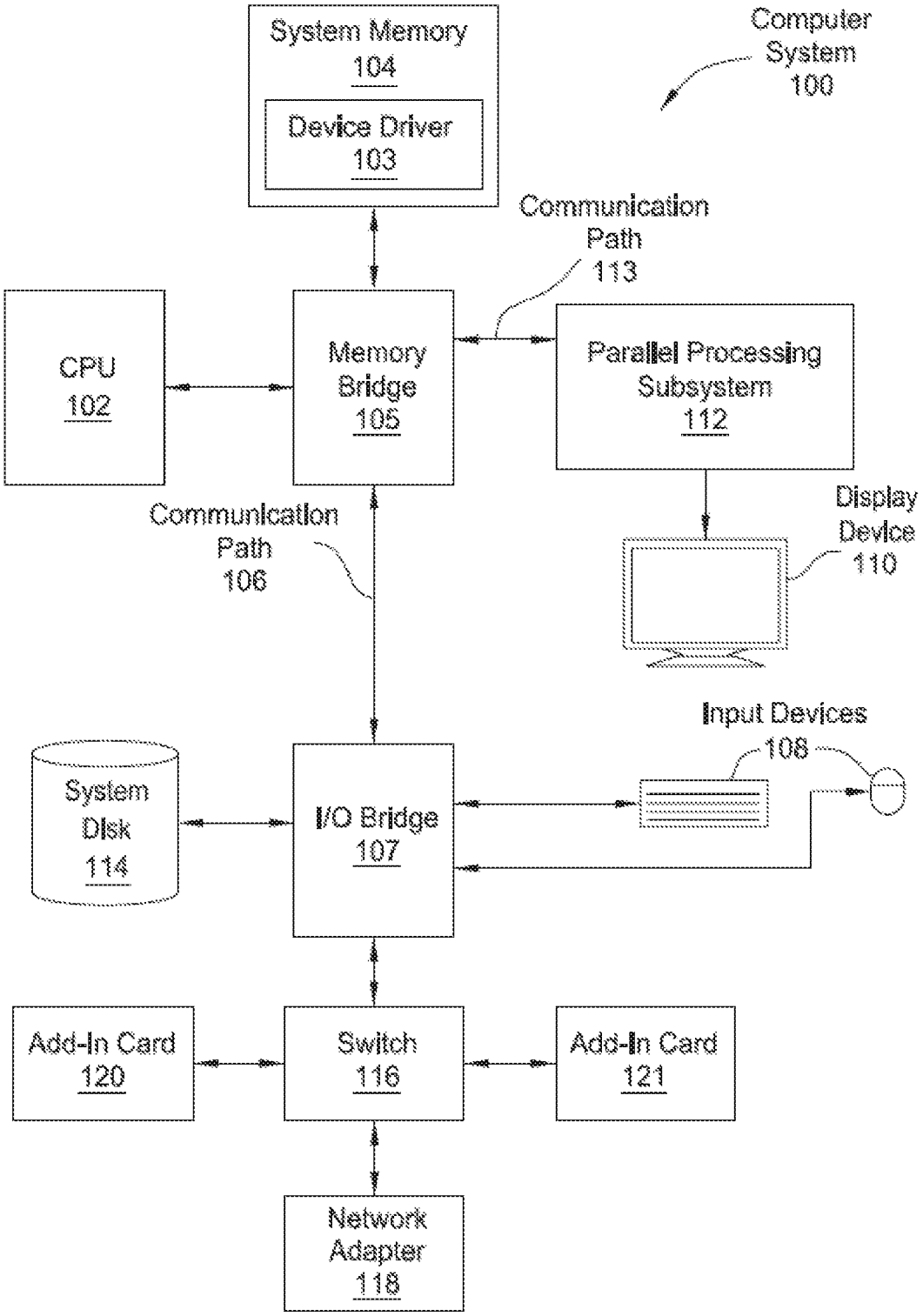
FIG. 1 is a block diagram illustrating a computer system configured to implement one or more aspects of the various embodiments.

FIG. 1 is a block diagram illustrating a computer system 100 configured to implement one or more aspects of the disclosure. As shown, computer system 100 includes, without limitation, a central processing unit (CPU) 102 and a system memory 104 coupled to a parallel processing subsystem 112 via a memory bridge 105 and a communication path 113. Memory bridge 105 is further coupled to an I/O (input/output) bridge 107 via a communication path 106, and I/O bridge 107 is, in turn, coupled to a switch 116.

In operation, I/O bridge 107 is configured to receive user input information from input devices 108, such as a keyboard or a mouse, and forward the input information to CPU 102 for processing via communication path 106 and memory bridge 105. Switch 116 is configured to provide connections between I/O bridge 107 and other components of the computer system 100, such as a network adapter 118 and various add-in cards 120 and 121.

As also shown, I/O bridge 107 is coupled to a system disk 114 that may be configured to store content and applications and data for use by CPU 102 and parallel processing subsystem 112. As a general matter, system disk 114 provides non-volatile storage for applications and data and may include fixed or removable hard disk drives, flash memory devices, and CD-ROM (compact disc read-only-memory), DVD-ROM (digital versatile disc-ROM), Blu-ray, HD-DVD (high definition DVD), or other magnetic, optical, or solid state storage devices. Finally, although not explicitly shown, other components, such as universal serial bus or other port connections, compact disc drives, digital versatile disc drives, film recording devices, and the like, may be connected to I/O bridge 107 as well.

In various embodiments, memory bridge 105 may be a Northbridge chip, and I/O bridge 107 may be a Southbrige chip. In addition, communication paths 106 and 113, as well as other communication paths within computer system 100, may be implemented using any technically suitable protocols, including, without limitation, AGP (Accelerated Graphics Port), HyperTransport, or any other bus or point-to-point communication protocol known in the art.

In various embodiments, parallel processing subsystem 112 comprises a graphics subsystem that delivers pixels to a display device 110 that may be any conventional cathode ray tube, liquid crystal display, light-emitting diode display, or the like. In such embodiments, the parallel processing subsystem 112 incorporates circuitry optimized for graphics and video processing, including, for example, video output circuitry. As described in greater detail below in FIG. 2, such circuitry may be incorporated across one or more parallel processing units (PPUs) included within parallel processing subsystem 112. In other embodiments, the parallel processing subsystem 112 incorporates circuitry optimized for general purpose and/or compute processing. Again, such circuitry may be incorporated across one or more PPUs included within parallel processing subsystem 112 that are configured to perform such general purpose and/or compute operations. In yet other embodiments, the one or more PPUs included within parallel processing subsystem 112 may be configured to perform graphics processing, general purpose processing, and compute processing operations. System memory 104 includes at least one device driver 103 configured to manage the processing operations of the one or more PPUs within parallel processing subsystem 112.

In various embodiments, parallel processing subsystem 112 may be integrated with one or more other the other elements of FIG. 1 to form a single system. For example, parallel processing subsystem 112 may be integrated with CPU 102 and other connection circuitry on a single chip to form a system on chip (SoC).

It will be appreciated that the system shown herein is illustrative and that variations and modifications are possible. The connection topology, including the number and arrangement of bridges, the number of CPUs 102, and the number of parallel processing subsystems 112, may be modified as desired. For example, in various embodiments, system memory 104 could be connected to CPU 102 directly rather than through memory bridge 105, and other devices would communicate with system memory 104 via memory bridge 105 and CPU 102. In other alternative topologies, parallel processing subsystem 112 may be connected to I/O bridge 107 or directly to CPU 102, rather than to memory bridge 105. In still other embodiments, I/O bridge 107 and memory bridge 105 may be integrated into a single chip instead of existing as one or more discrete devices. Lastly, in certain embodiments, one or more components shown in FIG. 1 may not be present. For example, switch 116 could be eliminated, and network adapter 118 and add-in cards 120, 121 would connect directly to I/O bridge 107.

Figure 2A:
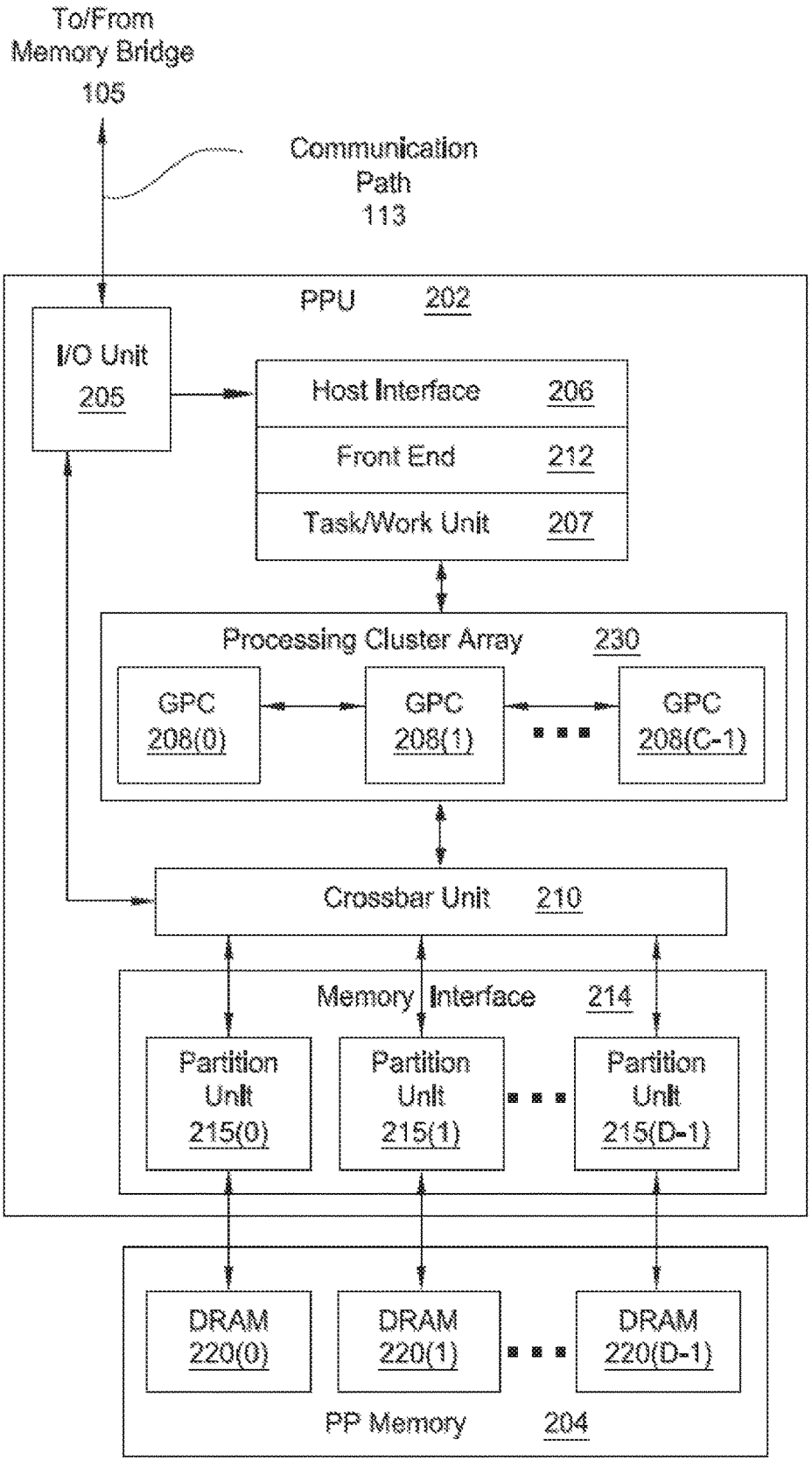
FIG. 2A is a block diagram of a parallel processing unit included in the parallel processing subsystem of FIG. 1, according to various embodiments.

FIG. 2A is a block diagram of a parallel processing unit (PPU) 202 included in the parallel processing subsystem 112 of FIG. 1, according to one embodiment of the disclosure. Although FIG. 2A depicts one PPU 202, as indicated above, parallel processing subsystem 112 may include any number of PPUs 202. As shown, PPU 202 is coupled to a local parallel processing (PP) memory 204. PPU 202 and PP memory 204 may be implemented using one or more integrated circuit devices, such as programmable processors, application specific integrated circuits (ASICs), or memory devices, or in any other technically feasible fashion.

In various embodiments, PPU 202 comprises a graphics processing unit (GPU) that may be configured to implement a graphics rendering pipeline to perform various operations related to generating pixel data based on graphics data supplied by CPU 102 and/or system memory 104. When processing graphics data, PP memory 204 can be used as graphics memory that stores one or more conventional frame buffers and, if needed, one or more other render targets as well. Among other things, PP memory 204 may be used to store and update pixel data and deliver final pixel data or display frames to display device 110 for display. In various embodiments, PPU 202 also may be configured for general-purpose processing and compute operations.

In operation, CPU 102 is the master processor of computer system 100, controlling and coordinating operations of other system components. In particular, CPU 102 issues commands that control the operation of PPU 202. In various embodiments, CPU 102 writes a stream of commands for PPU 202 to a data structure (not explicitly shown in either FIG. 1 or FIG. 2) that may be located in system memory 104, PP memory 204, or another storage location accessible to both CPU 102 and PPU 202. A pointer to the data structure is written to a pushbuffer to initiate processing of the stream of commands in the data structure. The PPU 202 reads command streams from the pushbuffer and then executes commands asynchronously relative to the operation of CPU 102. In embodiments where multiple pushbuffers are generated, execution priorities may be specified for each pushbuffer by an application program via device driver 103 to control scheduling of the different pushbuffers.

As also shown, PPU 202 includes an I/O (input/output) unit 205 that communicates with the rest of computer system 100 via the communication path 113 and memory bridge 105. I/O unit 205 generates packets (or other signals) for transmission on communication path 113 and also receives all incoming packets (or other signals) from communication path 113, directing the incoming packets to appropriate components of PPU 202. For example, commands related to processing tasks may be directed to a host interface 206, while commands related to memory operations (e.g., reading from or writing to PP memory 204) may be directed to a crossbar unit 210. Host interface 206 reads each pushbuffer and transmits the command stream stored in the pushbuffer to a front end 212.

As mentioned above in conjunction with FIG. 1, the connection of PPU 202 to the rest of computer system 100 may be varied. In various embodiments, parallel processing subsystem 112, which includes at least one PPU 202, is implemented as an add-in card that can be inserted into an expansion slot of computer system 100. In other embodiments, PPU 202 can be integrated on a single chip with a bus bridge, such as memory bridge 105 or I/O bridge 107. Again, in still other embodiments, some or all of the elements of PPU 202 may be included along with CPU 102 in a single integrated circuit or system of chip (SoC).

In operation, front end 212 transmits processing tasks received from host interface 206 to a work distribution unit (not shown) within task/work unit 207. The work distribution unit receives pointers to processing tasks that are encoded as task metadata (TMD) and stored in memory. The pointers to TMDs are included in a command stream that is stored as a pushbuffer and received by the front end unit 212 from the host interface 206. Processing tasks that may be encoded as TMDs include indices associated with the data to be processed as well as state parameters and commands that define how the data is to be processed. For example, the state parameters and commands could define the program to be executed on the data. The task/work unit 207 receives tasks from the front end 212 and ensures that GPCs 208 are configured to a valid state before the processing task specified by each one of the TMDs is initiated. A priority may be specified for each TMD that is used to schedule the execution of the processing task. Processing tasks also may be received from the processing cluster array 230. Optionally, the TMD may include a parameter that controls whether the TMD is added to the head or the tail of a list of processing tasks (or to a list of pointers to the processing tasks), thereby providing another level of control over execution priority.

PPU 202 advantageously implements a highly parallel processing architecture based on a processing cluster array 230 that includes a set of C general processing clusters (GPCs) 208, where C≥1. Each GPC 208 is capable of executing a large number (e.g., hundreds or thousands) of threads concurrently, where each thread is an instance of a program. In various applications, different GPCs 208 may be allocated for processing different types of programs or for performing different types of computations. The allocation of GPCs 208 may vary depending on the workload arising for each type of program or computation.

Memory interface 214 includes a set of D of partition units 215, where D≥1. Each partition unit 215 is coupled to one or more dynamic random access memories (DRAMs) 220 residing within PPM memory 204. In one embodiment, the number of partition units 215 equals the number of DRAMs 220, and each partition unit 215 is coupled to a different DRAM 220. In other embodiments, the number of partition units 215 may be different than the number of DRAMs 220. Persons of ordinary skill in the art will appreciate that a DRAM 220 may be replaced with any other technically suitable storage device. In operation, various render targets, such as texture maps and frame buffers, may be stored across DRAMs 220, allowing partition units 215 to write portions of each render target in parallel to efficiently use the available bandwidth of PP memory 204.

A given GPCs 208 may process data to be written to any of the DRAMs 220 within PP memory 204. Crossbar unit 210 is configured to route the output of each GPC 208 to the input of any partition unit 215 or to any other GPC 208 for further processing. GPCs 208 communicate with memory interface 214 via crossbar unit 210 to read from or write to various DRAMs 220. In one embodiment, crossbar unit 210 has a connection to I/O unit 205, in addition to a connection to PP memory 204 via memory interface 214, thereby enabling the processing cores within the different GPCs 208 to communicate with system memory 104 or other memory not local to PPU 202. In the embodiment of FIG. 2, crossbar unit 210 is directly connected with I/O unit 205. In various embodiments, crossbar unit 210 may use virtual channels to separate traffic streams between the GPCs 208 and partition units 215.

Again, GPCs 208 can be programmed to execute processing tasks relating to a wide variety of applications, including, without limitation, linear and nonlinear data transforms, filtering of video and/or audio data, modeling operations (e.g., applying laws of physics to determine position, velocity and other attributes of objects), image rendering operations (e.g., tessellation shader, vertex shader, geometry shader, and/or pixel/fragment shader programs), general compute operations, etc. In operation, PPU 202 is configured to transfer data from system memory 104 and/or PP memory 204 to one or more on-chip memory units, process the data, and write result data back to system memory 104 and/or PP memory 204. The result data may then be accessed by other system components, including CPU 102, another PPU 202 within parallel processing subsystem 112, or another parallel processing subsystem 112 within computer system 100.

As noted above, any number of PPUs 202 may be included in a parallel processing subsystem 112. For example, multiple PPUs 202 may be provided on a single add-in card, or multiple add-in cards may be connected to communication path 113, or one or more of PPUs 202 may be integrated into a bridge chip. PPUs 202 in a multi-PPU system may be identical to or different from one another. For example, different PPUs 202 might have different numbers of processing cores and/or different amounts of PP memory 204. In implementations where multiple PPUs 202 are present, those PPUs may be operated in parallel to process data at a higher throughput than is possible with a single PPU 202. Systems incorporating one or more PPUs 202 may be implemented in a variety of configurations and form factors, including, without limitation, desktops, laptops, handheld personal computers or other handheld devices, servers, workstations, game consoles, embedded systems, virtual reality and augmented reality devices, and the like.

Figure 2B:
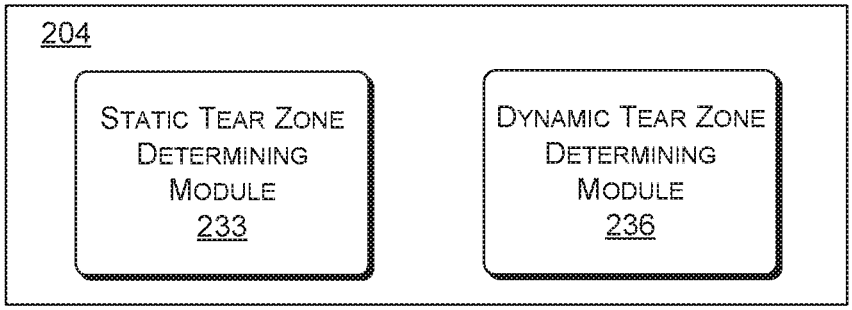
FIG. 2B is a detailed block diagram of the PP memory included in the parallel processing unit of FIG. 2A, according to various embodiments.

FIG. 2B is a detailed block diagram of PP memory 204 included in the parallel processing unit of FIG. 2A, according to various embodiments. PP memory 204 includes a static tear zone determining module 233 and a dynamic tear zone determining module 236, both of which may be application programs executable by GPCs 208, for example. In operation, static tear zone determining module 233 may determine coordinates of tear zone in a predetermined fashion. For example, as described in detail below, static tear zone determining module 233 may retrieve metadata from PP memory 204 that includes information regarding at least one location of a scene of a frame where all objects within the at least one location are static. Static tear zone determining module 233 may determine coordinates of a tear zone in this location. In another example, as described in detail below, dynamic tear zone determining module 236 may determine coordinates of one or more tear zones in real time based, at least in part, on content of a displayed frame.

It will be appreciated that the core architecture described herein is illustrative and that variations and modifications are possible. Among other things, any number of processing units may be included within GPC 208. Further, PPU 202 may include any number of GPCs 208 that are configured to be functionally similar to one another so that execution behavior does not depend on which GPC 208 receives a particular processing task. Further, each GPC 208 operates independently of the other GPCs 208 in PPU 202 to execute tasks for one or more application programs. In view of the foregoing, persons of ordinary skill in the art will appreciate that the architecture described in FIGS. 1, 2A, and 2B in no way limits the scope of the disclosure.

Tear Lines in Regions of a Display

Figure 3:
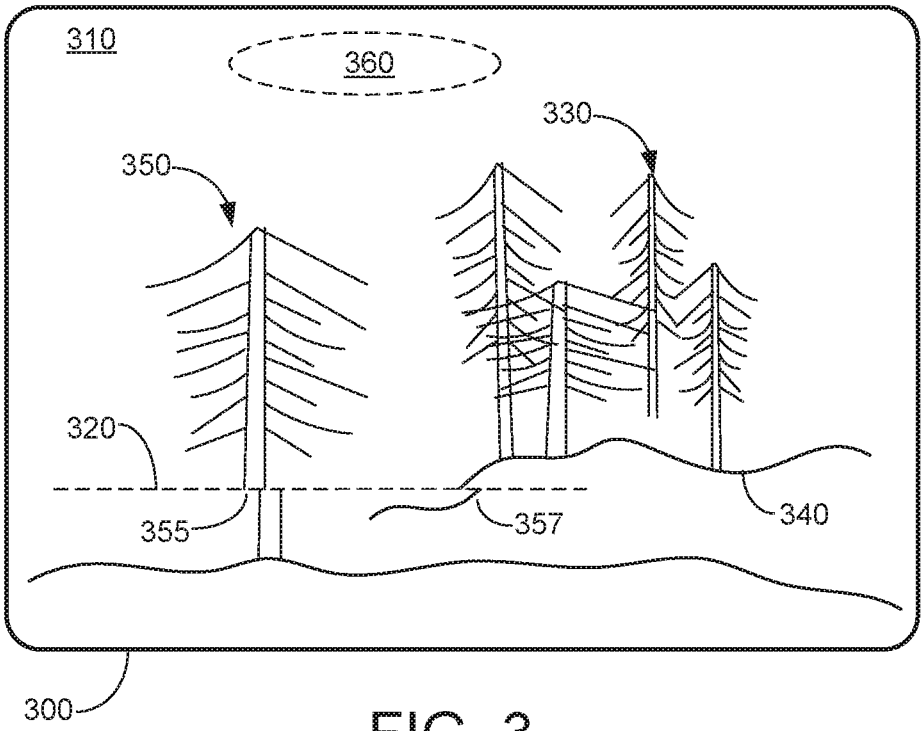
FIG. 3 illustrates a displayed image that includes a tear line, according to various embodiments.

FIG. 3 illustrates a display device 300 displaying an image 310 that includes a tear line 320, according to an embodiment. In one example, image 310 may be a single frame of a plurality of frames of a video, which may be stored in a memory device or may be streaming. In another example, image 310 may be a single image generated by a video game application. In either example (among other possibilities), various portions or objects of image 310 may move at different rates relative to other portions or objects of image 310 or may move relative to an edge of display device 300. For instance, a video object (hereinafter, "object"), such as 330, may change positions in the display from frame to frame relatively slowly compared to objects 340 and 350. Processing video of relatively fast moving objects or scenes may not be fast enough to keep in sync with the refresh rate of display device 300. Thus, tear line 320 may occur and is apparent at region 355 where a portion of object 350 (which may be moving across the display relatively fast) is discontinuously shifted. Tear line 320 is also apparent at region 357 where a portion of video object 340 is discontinuously shifted.

Generally, a tear line, such as 320, may occur at any horizontal line of pixels between the lower and the upper edges of display device 300. Often, there are portions of an image (of a video) that are more interesting to a viewer as compared to other portions. For example, in the case where image 310 is a frame of a video, object 350, particularly around region 355, may be relatively interesting if an important event or object of the video occurs around region 355. Thus, a tear line in region 355 may be distracting and may lead to a poor viewer experience. On the other hand, the viewer may not be distracted and may not notice a tear line occurring in a region 360 that is relatively unimportant to the viewer. Accordingly, in various embodiments, static tear zone determining module 233 or dynamic tear zone determining module 236 may impose a restriction on where tear lines are permitted to occur in a display. Such restrictions determine, for example, one or more areas (e.g., tear zones) where a tear line is permitted to occur. For instance, static tear zone determining module 233 or dynamic tear zone determining module 236 may permit tear lines to occur around region 360, and not permit tear lines to occur elsewhere, as described below. Static tear zone determining module 233 may select tear zones statically and dynamic tear zone determining module 236 may select tear zones dynamically. For static selection, tear zones may be a priori selected and constant, regardless of displayed images. For dynamic selection, tear zones may be selected in real-time based, at least in part, on area(s) of relatively important objects of a video or image in the display. A processor, which may be the same as or similar to PPU 202 (which comprises a GPU) of FIG. 2, may execute applications corresponding to static tear zone determining module 233 and dynamic tear zone determining module 236. PPU 202, however, is only one example of a processor that can implement the concepts and operations described herein.

Figure 4:
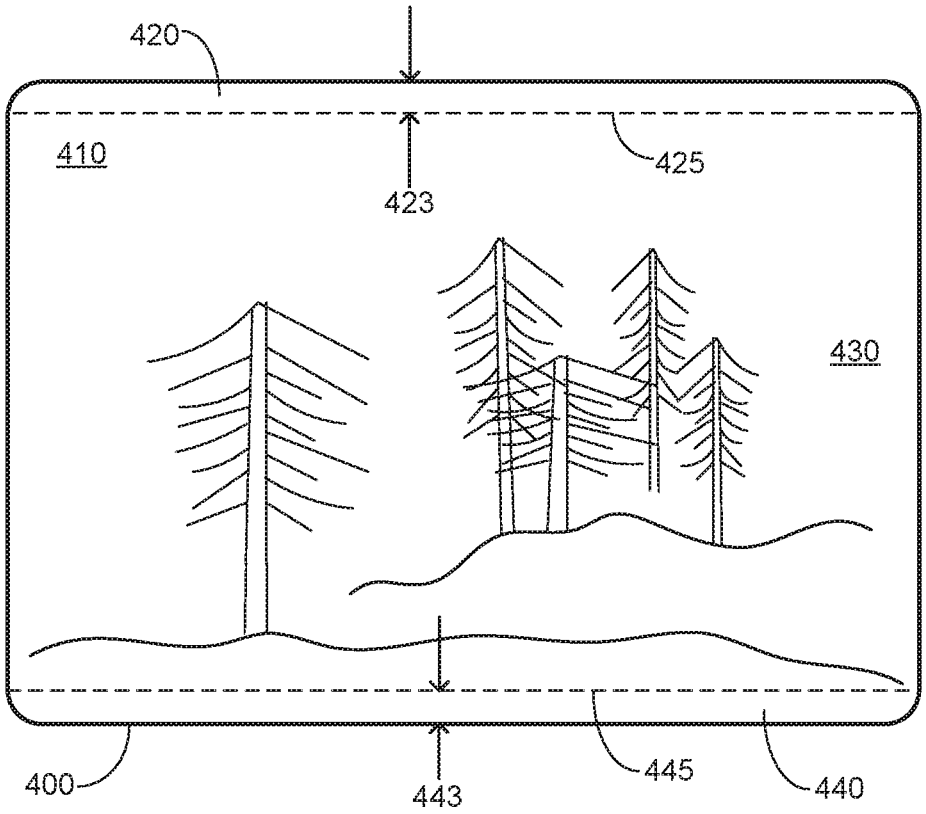
FIG. 4 illustrates a displayed image and regions where tear lines are permitted, according to various embodiments.

FIG. 4 illustrates a display device 400 displaying an image 410, according to various embodiments. Display device 400 may be the same as or similar to 300 illustrated in FIG. 3. Generally, outer regions of an image (e.g., of a video), such as relatively near edges of display device 400, tend to be relatively unimportant to a viewer. In other words, most or all of the interesting action or imagery generally occurs in a central portion of a display. Thus, the viewer may not notice or be distracted by a tear line occurring in such outer regions. Accordingly, in various embodiments, one or more areas, or tear zones, of the display where a tear line is permitted to occur may be statically selected and predetermined (e.g., a priori selected), as described above. A processor may accordingly allow tear lines to occur in the tear zones. A predetermined region where tear lines are permitted to occur is, for example, an upper portion 420 of display device 400. Upper portion 420 may, for instance, comprise the first (e.g., top-most) predetermined number of pixel rows 423 with an edge 425 that borders with a region 430, which is a portion of display device 400 where tear lines are not permitted to occur. Another predetermined region where tear lines may be permitted to occur is, for example, a lower portion 440 of display device 400. Lower portion 440 may, for instance, comprise the last (e.g., bottom-most) predetermined number of pixel rows 443 with an edge 445 that borders with region 430. In various embodiments, a viewer of display device 400 may select the predetermined number of pixel rows 423 and 443. In other embodiments, the predetermined number of pixel rows 423 and 443 may be selected arbitrarily (e.g., the predetermined number may be 10, 20, 30, or so rows). In still other embodiments, the predetermined number of pixel rows 423 and 443 may be selected based on empirical trial or training data.

Figure 5:
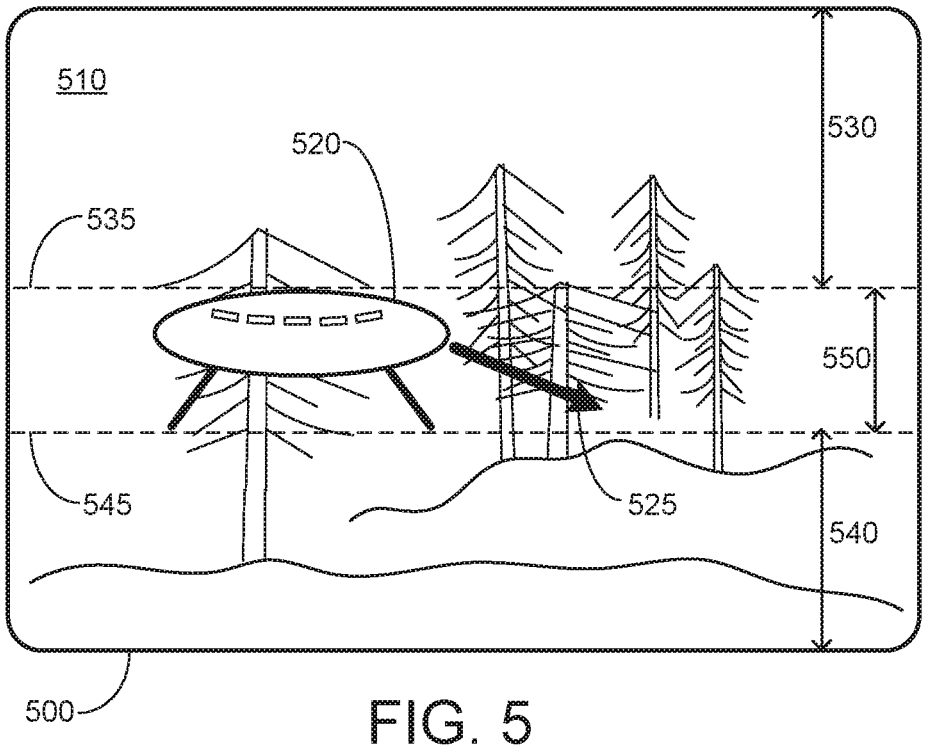
FIG. 5 illustrates a displayed image that includes a moving object of interest and a corresponding region where tear lines are not permitted, according to various embodiments.

FIG. 5 illustrates a display device 500 displaying an image 510 that includes an object 520 of interest, according to various embodiments. Display device 500 may be the same as or similar to 400 illustrated in FIG. 4. In embodiments associated with FIG. 4, one or more areas (e.g., 420 and 440) of the display where a tear line is permitted to occur are statically selected and predetermined. In the various embodiments associated with FIG. 5, however, one or more areas of the display where a tear line is permitted to occur are dynamically selected and based, at least in part, on a location(s) of an object(s) that is (are) of relatively high interest to a viewer. In the example illustrated in FIG. 5, such an object is object 520. In a particular example, object 520 may be a flying ship in a movie video or in a video game (e.g., which may be controlled by a player of the video game or may interact with the player). In a frame-to-frame motion, object 520 is moving in a direction indicated by arrow 525.

Generally, regions other than an object of interest, such as 520, tend to be relatively unimportant to a viewer. Thus, the viewer may not notice or be distracted by a tear line occurring in regions of display 510 that are vertically distant from object 520. Accordingly, in various embodiments, tear zones where a tear line is permitted to occur may be dynamically selected based, at least in part, on a location (or locations) of an object (or objects) of interest. A processor may allow tear lines to occur in the tear zones. In the example embodiment of FIG. 5, a region where tear lines are permitted to occur is, for example, an upper portion 530 of display 500 that comprises all pixel rows above object 520, or above row 535. Another region where tear lines may be permitted to occur is, for example, a lower portion 540 that comprises all pixel rows below object 520, or below row 545. Pixel rows that include at least a portion of object 520 comprise a portion 550 of display 500 where tear lines are not permitted to occur.

In various embodiments, as object 520 moves in display 500 in subsequent consecutive image frames, the processor updates the locations of the regions (e.g., 530 and 540) where tear lines are permitted to occur and updates the location of the region (e.g., 550) where tear lines are not permitted to occur.

In various embodiments, the processor may identify object 520, or additional objects of interest, using any of a number of types of image identification techniques. For example, the processor may be able to dynamically identify objects, such as humans, faces, animals, flying objects, and so on, which have a high likelihood of being important to a viewer. Upon or after being identified, locations of such objects in an image may be determined. Restrictions on where tear lines are not permitted to occur may be based, at least in part, on the determined locations. The processor may be the same as or similar to PPU 202 of FIG. 2. PPU 202, however, is only one example of a processor that can implement the concepts and operations described herein. All processors and processing elements and units fall within the scope of the present invention.

Figure 6:
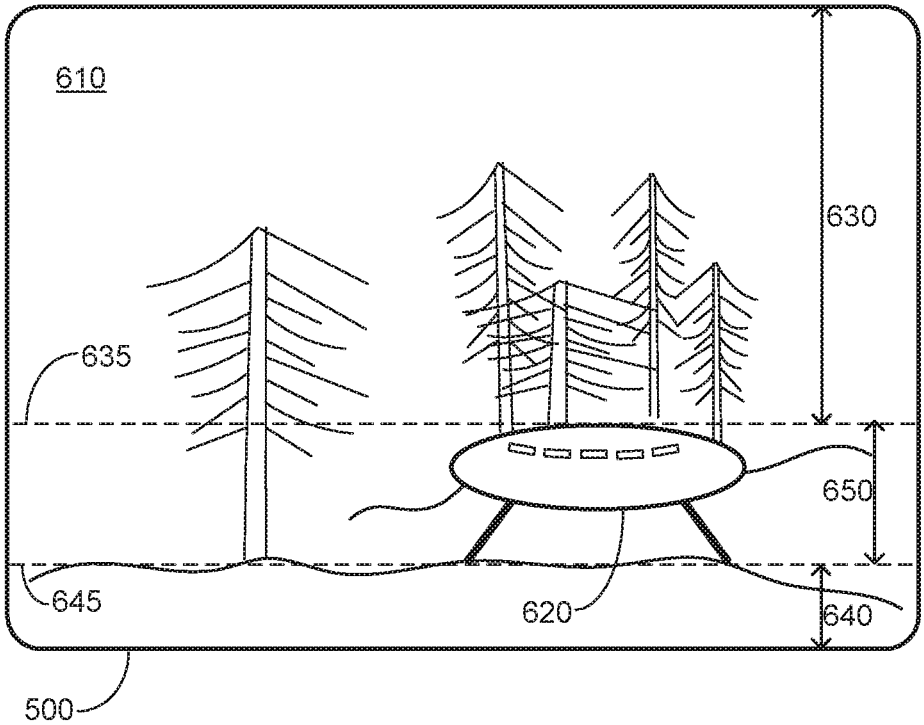
FIG. 6 illustrates a displayed image that includes a static object of interest and a corresponding region where tear lines are not permitted, according to various embodiments.

FIG. 6 illustrates display device 500 displaying an image 610 that includes object 520, having a location that is different from that in image 510 illustrated in FIG. 5, according to various embodiments. A region where tear lines are permitted to occur is, for example, an upper portion 630 of display 500 that comprises all pixel rows above object 520, or row 635. Another region where tear lines may be permitted to occur is, for example, a lower portion 640 that comprises all pixel rows below object 520, or below row 645. Pixel rows that include at least a portion of object 520 comprise a portion 650 of display 500 where tear lines are not permitted to occur.

As can be observed by comparing FIGS. 5 and 6 with one another, as object 520 moves in display 500 in consecutive image frames, the processor updates the locations of the regions where tear lines are permitted to occur and updates the location of the region where tear lines are not permitted to occur. Thus, for example, the location of the region where tear lines are not permitted to occur moved (from region 550 to region 650) with the motion of object 520.

Static Technique for Determining Tear Zones

Figure 7:
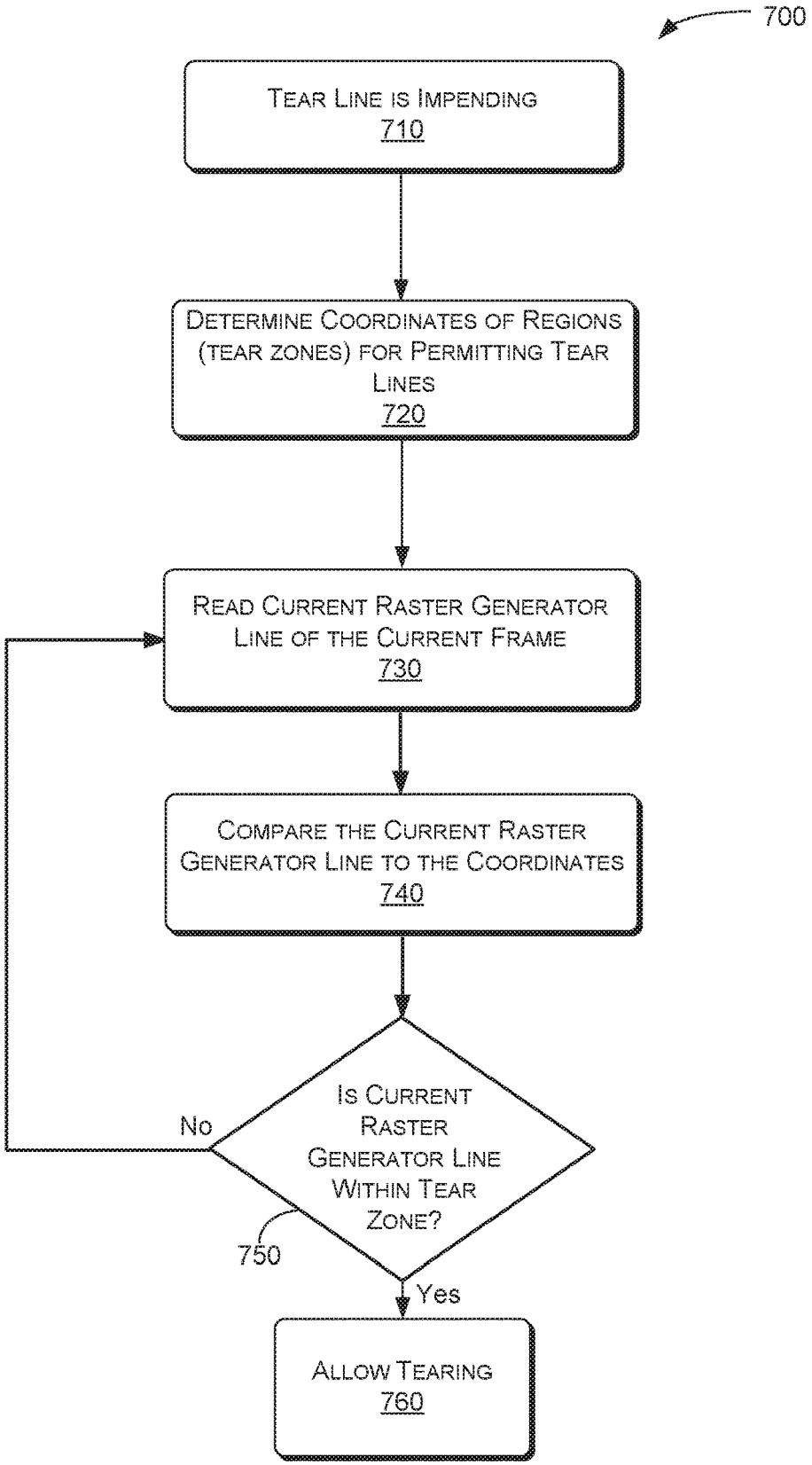
FIG. 7 is a flow diagram of method steps for determining regions of a display where tear lines are permitted or not permitted, according to various embodiments.

FIG. 7 is a flow diagram of method steps for statically determining regions of a display, such as that of display device 500, where tear lines are permitted or not permitted, according to various embodiments. Although the method steps are described with reference to the systems of FIGS. 1, 2A, and 2B, persons skilled in the art will understand that any system configured to implement the method steps, in any order, falls within the scope of the present invention.

Tear zones may be predetermined and, for example, their coordinates may be stored in a memory device. In some implementations, predetermined tear zones may be stored as metadata associated with individual frames (or groups of frames). For example, such metadata may include information regarding at least one location of a scene of a frame where all objects within the at least one location are static. A tear line in this location would be permitted.

As shown, a method 700 begins at step 710, where static tear zone determining module 233 (hereinafter, "module 233") determines that a tear line is impending due to, for example, a mismatch between a rate of processing a frame and a refresh rate of display device 500 (hereinafter, "display"). The frame may be one of a plurality of frames for a video, for example.

At step 720, module 233 determines coordinates of the display for one or more portions of the display for which tear lines are permitted or not permitted to occur. Such portions may be hereinafter referred to as "tear zones." The tear zones may be predetermined regions such as, for example, an upper portion of the display (e.g., 420 of display device 400) and/or a lower portion of the display (e.g., 440 of display device 400). In a particular implementation, the upper and/or lower portions may be the top and bottom ten or so rows of pixels, for example. Such portions of a display are generally out of primary view and focus of a viewer and a tear line in these portions may be less noticeable as compared to tear lines occurring in more centrally located portions of the display.

At step 730, when a frame is ready to be scanned out from the system to the display (e.g., a frame transition), module 233 (e.g., via parallel processing subsystem 112) reads the current raster generator line of the frame. At step 740, module 233 compares the current raster generator line to the coordinates of the tear zones. At step 750, module 233 determines, based at least in part on the comparison at step 740, whether the current raster generator line corresponds to any pixel rows in any of the tear zones. If so, then module 233 proceeds to step 760 where module 233 allows the tear line to occur. On the other hand, if the current raster generator line does not correspond to any pixel rows in any of the tear zones, then module 233 delays transitioning the currently displayed frame to the new frame. Module 233 returns to step 730 where module 233 again reads a current raster generator line of the frame. In some situations, a new raster generator line may "replace" the previous raster generator line during the time span between when the system previously performed the read operation at step 730 and when the system currently performs the read operation at step 730. In such situations, at step 740, a comparison of the new current raster generator line to the coordinates of the tear zones may lead to results different from the previous comparison. Accordingly, at step 750, module 233 may determine that the new current raster generator line is in a tear zone. If so, then module 233 proceeds to step 760 where module 233 allows the tear line to occur. If not, then module 233 again returns to step 730 where the system reads a current raster generator line of the frame. Such a functional loop back to step 730 may repeat until the most current raster generator line is in at least one of the tear zones.

Dynamic Technique for Determining Tear Zones

Figure 8:
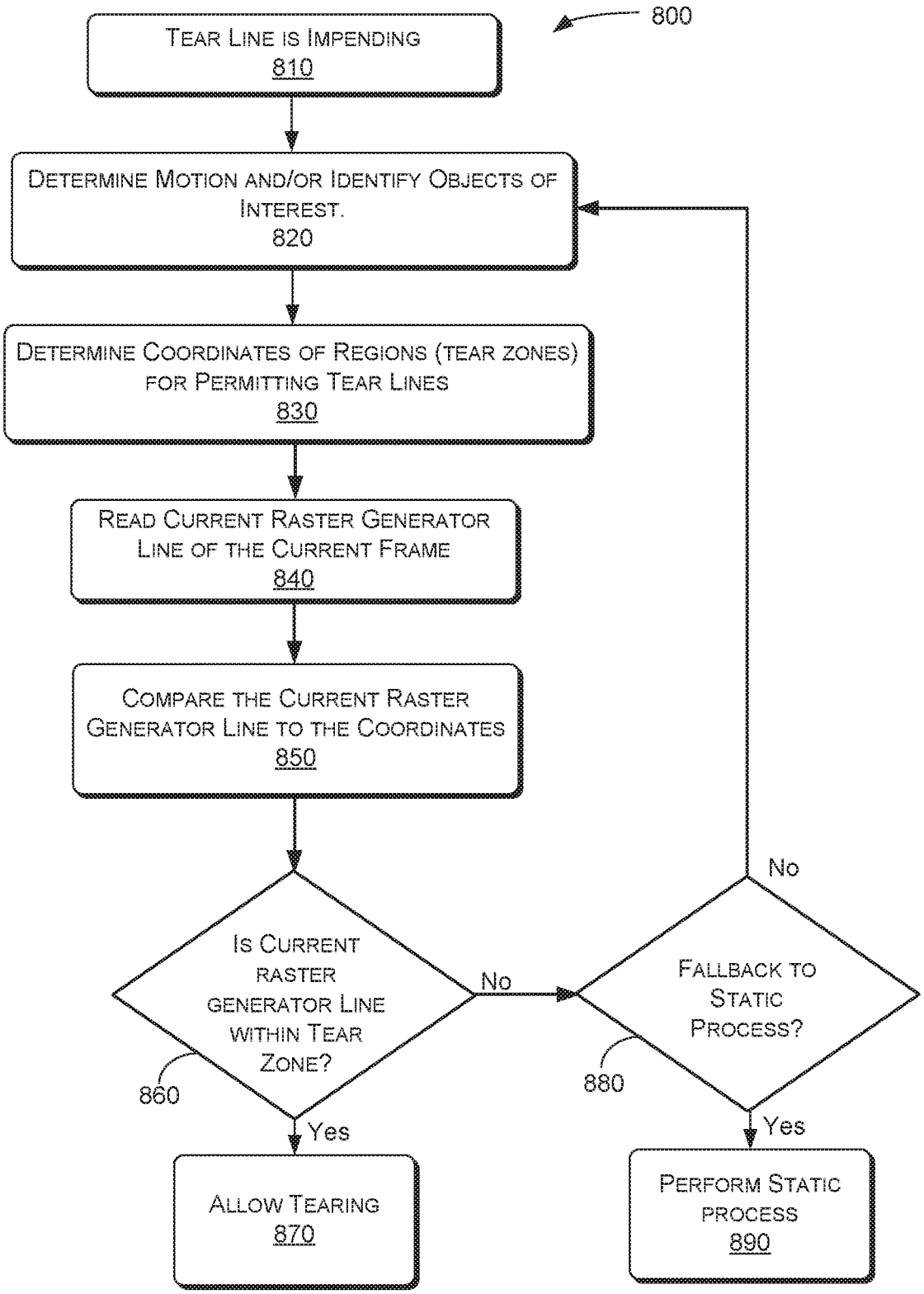
FIG. 8 is a flow diagram of method steps for determining regions of a display where tear lines are permitted or not permitted, according to other various embodiments.

FIG. 8 is a flow diagram for method steps for dynamically determining regions of a display, such as that of display device 500, where tear lines are permitted or not permitted, according to various embodiments. Although the method steps are described in conjunction with systems of FIGS. 1, 2A, and 2B, persons skilled in the art will understand that any system configured to perform the various steps of the method, in any order, is within the scope of the present invention.

Tear zones may be determined in real time based, at least in part, on content of a displayed frame. In some implementations, locations of tear zones may be based on motion (or lack of motion) of objects in the frame. For instance, a tear zone may be located so that a tear line is not permitted to occur through objects that move relatively fast or are not stationary. In other implementations, locations of tear zones may be based on type of objects (e.g., objects of interest) in the frame. For instance, a tear zone may be located so that a tear line is not permitted to occur through objects of interest (e.g., a face, person, animal, etc.). In yet other implementations, a tear zone may be determined based, at least in part, on motion of a game object generated by a video game application in the frame. In still other implementations, a tear zone may be determined based, at least in part, on whether the motion of an object is controlled by a user via a user interface. For example, an object, such as a game object, may be moved (e.g., controlled) by a user operating a joy stick, mouse, or other user interface.

As shown, a method 800 begins at step 810, where dynamic tear zone determining module 236 (hereinafter, "module 236") determines that a tear line is impending due to, for example, a mismatch between a rate of processing a frame and a refresh rate of display device 500 (hereinafter, "display"). The frame may be one of a plurality of frames for a video, for example.

At step 820, in some implementations, module 236 may identify one or more objects of interest using any of a number of types of image identification techniques. For example, module 236 may be able to dynamically identify objects, such as humans, faces, animals, and so on, which have a high likelihood of being important to a viewer. Upon or after being identified, locations of such objects in an image may be determined. Subsequently, module 236 may determine coordinates of regions where such objects of interest are located and thus determine where tear lines are not permitted to occur. For example, if an object of importance, such as 520 (e.g., the flying ship illustrated in FIG. 5), occupied at a particular time pixel rows 100 to 180 of a display that includes 256 pixel rows, then tear zones may be pixel rows 1-99 and 181-256.

Continuing at step 820, in some implementations, module 236 may include an eye-gaze tracking device (not illustrated) to determine the portion of the display at where the viewer is looking. Subsequently, module 236 may determine coordinates of the portion and thus determine where tear lines are not permitted to occur. For example, the gaze of the viewer at a particular time may be at a portion of the display where there is no object of interest, yet a tear line occurring at that portion and time may nevertheless be distracting. Thus, a tear line in this portion of the display at the particular time is not permitted to occur.

Continuing at step 820, in yet other implementations, module 236 may determine motion of various objects in the frame. Module 236 may perform such a determination by detecting, for example, motion vectors in the frame by comparing the frame to a previous frame. Thus, a portion of the frame that is not moving or changing (e.g., from frame to frame) may be a desirable area of the display for a tear line to occur. Tear zones may thus be determined accordingly.

At step 830, module 236 determines coordinates for tear zones of the display using motion and/or identity information determined in step 820. At step 840, when a frame is ready to be scanned out from the system to the display (e.g., a frame transition), the system (e.g., via parallel processing subsystem 112) reads the current raster generator line of the frame. At step 850, module 236 compares the current raster generator line to the coordinates of the tear zones. At step 860, module 236 determines, based at least in part on the comparison at step 850, whether the current raster generator line corresponds to any pixel rows in any of the tear zones. If so, then module 236 proceeds to step 870 where module 236 allows the tear line to occur in one of the tear zones. On the other hand, if the current raster generator line does not correspond to any pixel rows in any of the tear zones, then module 236 proceeds to step 880, where a determination, explained below, is made as to whether module 236 should perform a static determination method, such as 700. If not, then module 236 delays the transition from the currently displayed frame to the new frame by returning to step 820 where module 236 again may identify one or more objects of interest and their locations and/or may determine motion of various objects and their locations in the frame.

Generally, in the time span between the previous and present performances of step 820, the one or more objects of interest and their locations, as well as the motion of various other objects and their locations may change. Thus, locations and/or sizes of tear zones may change accordingly. Subsequent processes involving steps 830 through 860 are repeated each time with the most recently determined tear zones. Moreover, in some situations, a new raster generator line may "replace" the previous raster generator line during the time span between when the system previously performed the read operation at step 840 and when the system currently performs the read operation at step 840. In such situations, at step 850, a comparison of the new current raster generator line to the coordinates of the tear zones (which may themselves be new) may lead to results different from the previous comparison. Accordingly, at step 860, module 236 may determine that the new current raster generator line is in a tear zone. If so, then module 236 proceeds to step 870 where module 236 allows the tear line to occur. If not, then module 236 again proceeds to step 880, where a determination is again made as to whether module 236 should perform a static determination process, such as that described above in conjunction with FIG. 7. In various embodiments, such a determination may be performed by considering whether all objects (e.g., the entire scene) of the frame is in motion (e.g., such as during a panning scene). In such a situation, all objects may be beyond a threshold value for speed and the system may proceed to step 890 where module 236 performs a static determination method, such as that described above in conjunction with FIG. 7. In such a case, instead of tear zones being dynamically determined based on video content, tear zones may be predetermined.

In other embodiments, such a determination in step 880 may be performed by considering a future likelihood that a raster generator line corresponds to any pixel rows in any of the tear zones. For example, if tear zones determined in step 830 are relatively few and/or small, it may be unlikely that a future raster generator line will correspond to a pixel row in any of the tear zones. Generally, the smaller the likelihood, the larger a time delay may occur for updating the display with the latest frame. Such large delays may be distracting or unacceptable. Thus, to avoid such a situation, in cases of too small a likelihood (e.g., below a threshold value) that a future raster generator line will correspond to a pixel row in a tear zone, module 236 may proceed to step 890 where module 236 performs a static determination method, such as that described above in conjunction with FIG. 7. In such a case, instead of tear zones being dynamically determined based on video content, tear zones may be predetermined.

Figure 9:
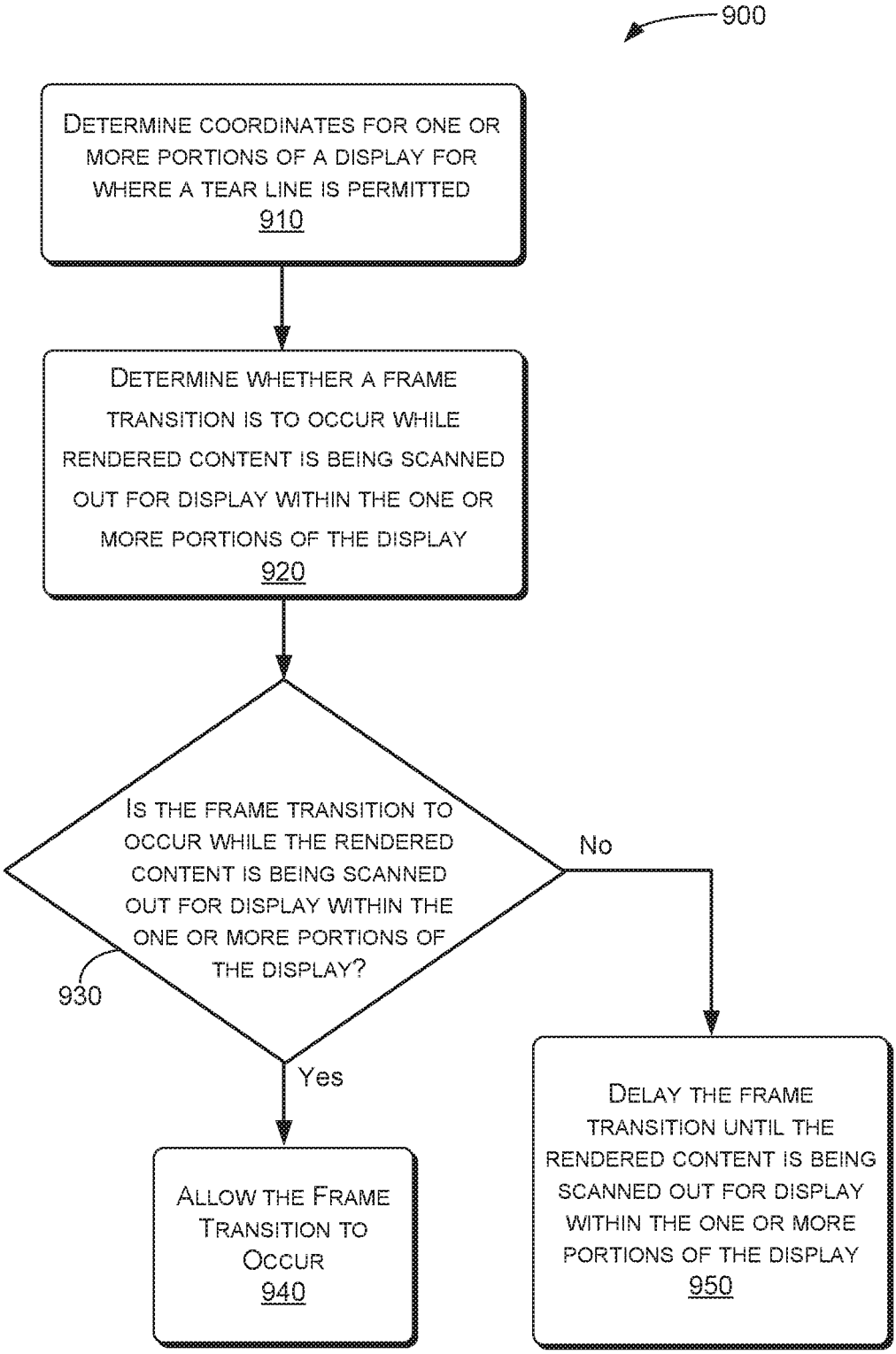
FIG. 9 is a flow diagram of method steps for determining whether or not to allow tear lines to occur in a display, according to various embodiments.

FIG. 9 is a flow diagram of method steps for determining whether or not to allow tear lines to occur in a display, according to various embodiments. Although the method steps are described with reference to the systems of FIGS. 1, 2A, and 2B, persons skilled in the art will understand that any system configured to implement the method steps, in any order, falls within the scope of the present invention.

As shown, a method 900 begins at step 910, where module 233 or module 236 determines coordinates for one or more portions of a display where a tear line is permitted. At step 920, module 233 or module 236 determines whether a frame transition is to occur while rendered content is being scanned out for display within the one or more portions of the display. At step 930, module 233 or module 236 determines if the frame transition is to occur while the rendered content is being scanned out for display within the one or more portions of the display. If so, then method 900 proceeds to 940, where module 233 or module 236 allows the frame transition to occur. If, however, the frame transition is to occur while the rendered content is being scanned out for display outside the one or more portions of the display, then method 900 proceeds to 950, where module 233 or module 236 delays the frame transition until the rendered content is being scanned out for display within the one or more portions of the display.

In sum, various embodiments set forth techniques and system architectures that allow for control of where tear lines occur in a display of a frame. Some techniques may be performed by a computing system and include receiving or determining coordinates for one or more portions of the display where a tear line is permitted, and determining whether a frame transition is to occur while rendered content is being scanned out for display within the one or more portions of the display. If the frame transition is to occur while the rendered content is being scanned out for display within the one or more portions of the display, then the computing system allows the frame transition to occur. If the frame transition is to occur while the rendered content is being scanned out for display outside of the one or more portions of the display, then the computing system delays the frame transition until the rendered content is being scanned out for display within the one or more portions of the display.

The disclosed techniques provide a technological improvement relative to the prior art in that dynamically detected video objects having relatively high importance may remain intact while screen tearing occurs in other portions of a display. With the disclosed techniques, screen tearing in relatively important parts of a frame is reduced or avoided without throttling the output of the graphics card and without introducing other undesirable visual artifacts.

1. In some embodiments, a method for determining tear lines when generating and displaying frames of content comprises: determining coordinates for one or more portions of a display where a tear line is permitted; determining whether a frame transition is to occur while rendered content is being scanned out for display within the one or more portions of the display where the tear line is permitted; and if the frame transition is to occur while the rendered content is being scanned out for display within the one or more portions of the display where the tear line is permitted, then allowing the frame transition to occur, or if the frame transition is to occur while the rendered content is being scanned out for display outside of the one or more portions of the display where the tear line is permitted, then delaying the frame transition until the rendered content is being scanned out for display within the one or more portions of the display where the tear line is permitted.

2. The method of clause 1, wherein determining the coordinates for the one or more portions of the display where the tear line is permitted comprises: determining a location of at least one object having a speed that is slower than a speed of another object in a current frame of rendered content among a plurality of frames of rendered content; and setting the coordinates for the one or more portions of the display where the tear line is permitted to correspond with the location of the at least one object.

3. The method of any of clauses 1-2, further comprising setting the coordinates for the one or more portions of the display where the tear line is permitted to predetermined values if the speed of the at least one object having the speed that is slower than the speed of the other object is beyond a threshold.

4. The method of any of clauses 1-3, wherein determining the coordinates for the one or more portions of the display where the tear line is permitted comprises: determining a location of at least one object having an importance that is less than an importance of another object in a latest frame of rendered content among a plurality of frames of rendered content; and setting the coordinates for the one or more portions of the display where the tear line is permitted to correspond with the location of the at least one object having the importance that is less than the importance of the other object.

5. The method of any of clauses 1-4, wherein determining the coordinates for the one or more portions of the display where the tear line is permitted comprises: receiving the coordinates for the one or more portions of the display where the tear line is permitted from a user interface.

6. The method of any of clauses 1-5, wherein determining the coordinates for the one or more portions of the display where the tear line is permitted comprises: determining a gaze direction of a user viewing the display; and setting the coordinates for the one or more portions of the display where the tear line is permitted based, at least in part, on the gaze direction of the user.

7. The method of any of clauses 1-6, wherein determining the coordinates for the one or more portions of the display where the tear line is permitted comprises: receiving metadata associated with a current frame of rendered content included in a plurality of frames of rendered content; and setting the coordinates for the one or more portions of the display where the tear line is permitted based, at least in part, on the metadata.

8. The method of any of clauses 1-7, wherein the metadata includes information associated with at least one location within the current frame of rendered content where all objects are static.

9. The method of any of clauses 1-8, further comprising determining the one or more portions of the display where the tear line is permitted where the tear line is permitted based, at least in part, on the rendered content being scanned out for display.

10. In some embodiments, a non-transitory computer-readable storage medium including instructions that, when executed by a processor, cause the processor to: receive coordinates for one or more portions of a display where a tear line is permitted; determine whether a frame transition is to occur while rendered content is being scanned out for display within the one or more portions of the display where the tear line is permitted; and if the frame transition is to occur while the rendered content is being scanned out for display within the one or more portions of the display where the tear line is permitted, then the processor is further configured to allow the frame transition to occur, or if the frame transition is to occur while the rendered content is being scanned out for display outside the one or more portions of the display where the tear line is permitted, then the processor is further configured to delay the frame transition until the rendered content is being scanned out for display within the one or more portions of the display where the tear line is permitted.

11. The non-transitory computer-readable storage medium of clause 10, wherein the instructions, when executed by the processor, cause the processor to: determine the coordinates for the one or more portions of the display where the tear line is permitted by: determining a location of at least one object having a speed that is slower than a speed of another object in a current frame of rendered content among a plurality of frames of rendered content; and setting the coordinates for the one or more portions of the display where the tear line is permitted to correspond with the location of the at least one object.

12. The non-transitory computer-readable storage medium of any of clauses 10-11, wherein the instructions, when executed by the processor, cause the processor to set the coordinates for the one or more portions of the display where the tear line is permitted to predetermined values if the speed of the at least one object having the speed that is slower than the speed of the other object is beyond a threshold.

13. The non-transitory computer-readable storage medium of any of clauses 10-12, wherein the instructions, when executed by the processor, cause the processor to: determine the coordinates for the one or more portions of the display where the tear line is permitted by: determining a location of at least one object having an importance that is less than an importance of another object in a latest frame of rendered content among a plurality of frames of rendered content; and setting the coordinates for the one or more portions of the display where the tear line is permitted to correspond with the location of the at least one object having the importance that is less than the importance of the other object.

14. The non-transitory computer-readable storage medium of any of clauses 10-13, wherein the processor is further configured to: determine the coordinates for the one or more portions of the display where the tear line is permitted by: determining a gaze direction of a user viewing of the display; and setting the coordinates for the one or more portions of the display where the tear line is permitted based, at least in part, on the gaze direction of the user.

15. The non-transitory computer-readable storage medium of any of clauses 10-14, wherein the processor is further configured to: determine the coordinates for the one or more portions of the display where the tear line is permitted by: receiving metadata associated with a current frame of rendered content included in a plurality of frames of rendered content; and setting the coordinates for the one or more portions of the display where the tear line is permitted based, at least in part, on the metadata.

16. The non-transitory computer-readable storage medium of any of clauses 10-15, wherein the current frame of rendered content comprises a video frame among a plurality of video frames of a video.

17. The non-transitory computer-readable storage medium of any of clauses 10-16, wherein the instructions, when executed by the processor, cause the processor to: determine the coordinates for the one or more portions of the display where the tear line is permitted by: determining a location of an object having a motion that is controlled by a user via a user interface; and setting the coordinates for the one or more portions of the display where the tear line is permitted to correspond with the location of the object.

18. The non-transitory computer-readable storage medium of any of clauses 10-17, wherein the processor is further configured to: determine the coordinates for the one or more portions of the display where the tear line is permitted by: setting the coordinates for the one or more portions of the display where the tear line is permitted based, at least in part, on motion of a game object in the current frame of rendered contents.

19. In some embodiments, a system comprises: a memory storing an application; and a processor coupled to the memory and, when executing the application, is configured to: receive coordinates for one or more portions of a display where a tear line is permitted; determine whether a frame transition is to occur while rendered content is being scanned out for display within the one or more portions of the display where the tear line is permitted; and if the frame transition is to occur while the rendered content is being scanned out for display is within the one or more portions of the display where the tear line is permitted, then the processor is further configured to allow the frame transition to occur, or if the frame transition is to occur while the rendered content is being scanned out for display outside the one or more portions of the display where the tear line is permitted, then the processor is further configured to delay the frame transition until the rendered content is being scanned out for display within the one or more portions of the display where the tear line is permitted.

20. The system of clause 19, further comprising an eye-tracking device, wherein the processor is further configured to: determine the coordinates for the one or more portions of the display where the tear line is permitted by: receiving a value for gaze direction of a user viewing the display from the eye-tracking device; and setting the coordinates for the one or more portions of the display where the tear line is permitted based, at least in part, on the gaze direction of the user. Any and all combinations of any of the claim elements recited in any of the claims and/or any elements described in this application, in any fashion, fall within the contemplated scope of the present invention and protection.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the various embodiments may be embodied as a system, technique, or computer program product. Accordingly, aspects of the various embodiments may take the form of an entirely hardware embodiment, an entirely software embodiment (including firmware, resident software, microcode, etc.) or an embodiment combining software and hardware aspects that may all generally be referred to herein as a "module" or "system." Furthermore, aspects of the various embodiments may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain or store a program for use by or in connection with an instruction execution system, apparatus, or device.

Aspects of the disclosure are described above with reference to flowchart illustrations and/or block diagrams of techniques, apparatus (systems) and computer program products according to various embodiments. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable processors.

The flowchart and block diagrams in the figures illustrate the architecture, functionality, and operation of possible implementations of systems, techniques, and computer program products according to various embodiments. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

Various features have been described above with reference to specific embodiments. Persons of ordinary skill in the art, however, will understand that various modifications and changes may be made thereto without departing from the broader spirit and scope of the embodiments as set forth in the appended claims. For example, and without limitation, although many of the descriptions herein refer to specific types of application data, content servers, and client devices, persons skilled in the art will appreciate that the systems and techniques described herein are applicable to other types of application data, content servers, and client devices. The foregoing description and drawings are, accordingly, to be regarded in an illustrative rather than a restrictive sense.

While the preceding is directed to embodiments of the disclosure, other and further embodiments of the disclosure may be devised without departing from the basic scope thereof, and the scope thereof is determined by the claims that follow.

What is claimed is:

1. A method for determining tear lines when generating and displaying frames of content, the method comprising:

determining coordinates for one or more portions of a display where a tear line is permitted based, at least in part, on a location of an object in a current frame of rendered content included in a plurality of frames of the rendered content, wherein the coordinates for the one or more portions of the display are dynamically changed based on a changing location of the object;

determining whether a frame transition is to occur while the rendered content is being scanned out for display within the one or more portions of the display where the tear line is permitted;

if the frame transition is to occur while the rendered content is being scanned out for display within the one or more portions of the display where the tear line is permitted, then allowing the frame transition to occur, and if the frame transition is to occur while the rendered content is being scanned out for display outside of the one or more portions of the display where the tear line is permitted, then delaying the frame transition until the rendered content is being scanned out for display within the one or more portions of the display where the tear line is permitted.

2. The method of claim 1, wherein determining the coordinates for the one or more portions of the display where the tear line is permitted comprises:

determining the location of the object, wherein the object has a first speed that is slower than a second speed of another object in the current frame of the rendered content; and setting the coordinates for the one or more portions of the display where the tear line is permitted to correspond with the location of the object.

3. The method of claim 2, further comprising setting the coordinates for the one or more portions of the display where the tear line is permitted to predetermined values if the first speed is beyond a threshold.

4. The method of claim 1, wherein determining the coordinates for the one or more portions of the display where the tear line is permitted comprises:

determining the location of the object, wherein the object has an importance that is less than an importance of another object in a latest frame of the rendered content included in the plurality of frames of the rendered content; and setting the coordinates for the one or more portions of the display where the tear line is permitted to correspond with the location of the object having the importance that is less than the importance of the another object.

5. The method of claim 1, wherein determining the coordinates for the one or more portions of the display where the tear line is permitted comprises:

determining a gaze direction of a user viewing the display; and setting the coordinates for the one or more portions of the display where the tear line is permitted based, at least in part, on the gaze direction of the user.

6. The method of claim 1, wherein determining the coordinates for the one or more portions of the display where the tear line is permitted comprises:

receiving metadata associated with the current frame of the rendered content; and setting the coordinates for the one or more portions of the display where the tear line is permitted based, at least in part, on the metadata.

7. The method of claim 6, wherein the metadata includes information associated with at least one location within the current frame of the rendered content where all objects are static.

8. The method of claim 1, further comprising determining the one or more portions of the display where the tear line is permitted based, at least in part, on the rendered content being scanned out for display.

9. One or more non-transitory computer-readable media including instructions that, when executed by one or more processors, cause the one or more processors to:

receive coordinates for one or more portions of a display where a tear line is permitted based, at least in part, on a location of an object in a current frame of rendered content included in a plurality of frames of the rendered content, wherein the coordinates for the one or more portions of the display are dynamically changed based on a changing location of the object;

determine whether a frame transition is to occur while the rendered content is being scanned out for display within the one or more portions of the display where the tear line is permitted;

if the frame transition is to occur while the rendered content is being scanned out for display within the one or more portions of the display where the tear line is permitted, then the processor is further configured to allow the frame transition to occur, and if the frame transition is to occur while the rendered content is being scanned out for display outside the one or more portions of the display where the tear line is permitted, then the processor is further configured to delay the frame transition until the rendered content is being scanned out for display within the one or more portions of the display where the tear line is permitted.

10. The one or more non-transitory computer-readable media of claim 9, wherein the instructions, when executed by the processor, cause the processor to:

determine the coordinates for the one or more portions of the display where the tear line is permitted by:

determining the location of the object, wherein the object has a first speed that is slower than a second speed of another object in the current frame of the rendered content; and setting the coordinates for the one or more portions of the display where the tear line is permitted to correspond with the location of the object.

11. The one or more non-transitory computer-readable media of claim 10, wherein the instructions, when executed by the processor, cause the processor to set the coordinates for the one or more portions of the display where the tear line is permitted to predetermined values if the first speed is beyond a threshold.

12. The one or more non-transitory computer-readable media of claim 9, wherein the instructions, when executed by the processor, cause the processor to:

determine the coordinates for the one or more portions of the display where the tear line is permitted by:

determining the location of the object, wherein the object has an importance that is less than an importance of another object in a latest frame of the rendered content included in the plurality of frames of the rendered content; and setting the coordinates for the one or more portions of the display where the tear line is permitted to correspond with the location of the object having the importance that is less than the importance of the another object.

13. The one or more non-transitory computer-readable media of claim 9, wherein the processor is further configured to:

determine the coordinates for the one or more portions of the display where the tear line is permitted by:

determining a gaze direction of a user viewing of the display; and setting the coordinates for the one or more portions of the display where the tear line is permitted based, at least in part, on the gaze direction of the user.

14. The one or more non-transitory computer-readable media of claim 9, wherein the processor is further configured to:

determine the coordinates for the one or more portions of the display where the tear line is permitted by:

receiving metadata associated with the current frame of the rendered content; and setting the coordinates for the one or more portions of the display where the tear line is permitted based, at least in part, on the metadata.

15. The one or more non-transitory computer-readable media of claim 14, wherein the current frame of the rendered content comprises a video frame among a plurality of video frames of a video.

16. The one or more non-transitory computer-readable media of claim 9, wherein the instructions, when executed by the processor, cause the processor to:

determine the coordinates for the one or more portions of the display where the tear line is permitted by:

determining the location of the object having a motion that is controlled by a user via a user interface; and setting the coordinates for the one or more portions of the display where the tear line is permitted to correspond with the location of the object.

17. The one or more non-transitory computer-readable media of claim 16, wherein the processor is further configured to:

determine the coordinates for the one or more portions of the display where the tear line is permitted by:

setting the coordinates for the one or more portions of the display where the tear line is permitted based, at least in part, on motion of a game object in the current frame of the rendered contents.

18. A system, comprising:

a memory storing an Application; and a processor coupled to the memory and, when executing the Application, is configured to:

receive coordinates for one or more portions of a display where a tear line is permitted based, at least in part, on a location of an object in a current frame of rendered content included in a plurality of frames of the rendered content, wherein the coordinates for the one or more portions of the display are dynamically changed based on a changing location of the object;

determine whether a frame transition is to occur while the rendered content is being scanned out for display within the one or more portions of the display where the tear line is permitted;

if the frame transition is to occur while the rendered content is being scanned out for display is within the one or more portions of the display where the tear line is permitted, then the processor is further configured to allow the frame transition to occur, and if the frame transition is to occur while the rendered content is being scanned out for display outside the one or more portions of the display where the tear line is permitted, then the processor is further configured to delay the frame transition until the rendered content is being scanned out for display within the one or more portions of the display where the tear line is permitted.

19. The system of claim 18, further comprising an eye-tracking device, wherein the processor is further configured to:

determine the coordinates for the one or more portions of the display where the tear line is permitted by:

receiving a value for gaze direction of a user viewing the display from the eye-tracking device; and setting the coordinates for the one or more portions of the display where the tear line is permitted based, at least in part, on the gaze direction of the user.

20. A method for determining tear lines when generating and displaying frames of content, the method comprising:

determining coordinates for one or more portions of a display where a tear line is permitted based, at least in part, on a location of an object in a current frame of rendered content included in a plurality of frames of the rendered content, wherein the coordinates for the one or more portions of the display are dynamically changed based on a changing location of the object, wherein determining the coordinates for the one or more portions of the display where the tear line is permitted comprises:

determining the location of the object, wherein the object has an importance that is less than an importance of another object in a latest frame of the rendered content included in the plurality of frames of the rendered content; and setting the coordinates for the one or more portions of the display where the tear line is permitted to correspond with the location of the object having the importance that is less than the importance of the another object;

determining whether a frame transition is to occur while the rendered content is being scanned out for display within the one or more portions of the display where the tear line is permitted; and if the frame transition is to occur while the rendered content is being scanned out for display within the one or more portions of the display where the tear line is permitted, then allowing the frame transition to occur, or if the frame transition is to occur while the rendered content is being scanned out for display outside of the one or more portions of the display where the tear line is permitted, then delaying the frame transition until the rendered content is being scanned out for display within the one or more portions of the display where the tear line is permitted.

* * * * *